US011174661B2

(12) United States Patent
Hunt et al.

(10) Patent No.: US 11,174,661 B2
(45) Date of Patent: Nov. 16, 2021

(54) MOTOR VEHICLE DOOR LATCH, IN PARTICULAR A TAILGATE LATCH

(71) Applicant: Kiekert AG, Heiligenhaus (DE)

(72) Inventors: Robert J. Hunt, Davisburg, MI (US); Adrin Wagner, Saline, MI (US); Patrick Mullins, Canton, MI (US); Ruben Reyna, Allen Park, MI (US)

(73) Assignee: Kiekert AG, Heiligenhaus (DE)

( * ) Notice: Subject to any disclaimer, the term of this patent is extended or adjusted under 35 U.S.C. 154(b) by 614 days.

(21) Appl. No.: 16/041,999

(22) Filed: Jul. 23, 2018

(65) Prior Publication Data

US 2019/0024417 A1 Jan. 24, 2019

Related U.S. Application Data

(60) Provisional application No. 62/535,285, filed on Jul. 21, 2017.

(51) Int. Cl.

| | |
|---|---|
| ***E05B 81/14*** | (2014.01) |
| ***E05B 85/26*** | (2014.01) |
| *E05B 83/18* | (2014.01) |

(52) U.S. Cl.

CPC ..... *E05B 81/15* (2013.01); *E05B 85/26* (2013.01); *E05B 83/18* (2013.01)

(58) Field of Classification Search

CPC ..... E05B 81/15; E05B 85/26; E05B 83/18

See application file for complete search history.

(56) References Cited

U.S. PATENT DOCUMENTS

| | | | | |
|---|---|---|---|---|
| 2003/0038485 | A1* | 2/2003 | Schwaiger | E05B 81/14 292/201 |
| 2015/0267441 | A1* | 9/2015 | Fuchs | E05B 81/66 292/200 |
| 2017/0159334 | A1* | 6/2017 | Ishiguro | E05B 77/36 |

FOREIGN PATENT DOCUMENTS

| | | | | |
|---|---|---|---|---|
| DE | 102007024672 | A1 * | 11/2008 | E05B 81/14 |
| WO | 2014/036991 | | 3/2014 | |
| WO | WO-2014036991 | A2 * | 3/2014 | E05B 81/15 |
| WO | 2016/000460 | | 1/2016 | |

* cited by examiner

*Primary Examiner* — Kristina R Fulton
*Assistant Examiner* — James Edward Ignaczewski
(74) *Attorney, Agent, or Firm* — Renner, Otto, Boisselle & Sklar, LLP

(57) ABSTRACT

A motor vehicle door latch, in particular a tailgate latch, which is equipped with a locking mechanism comprising a catch and a pawl. Furthermore, a triggering element working on the pawl is provided for which is set up at least to lift the pawl. Furthermore, a memory element, which at least guarantees an unimpeded opening movement of the catch when the pawl is lifted. The memory element maintains the pawl in its elevated position.

19 Claims, 3 Drawing Sheets

MOTOR VEHICLE DOOR LATCH, IN PARTICULAR A TAILGATE LATCH

Figure 1:
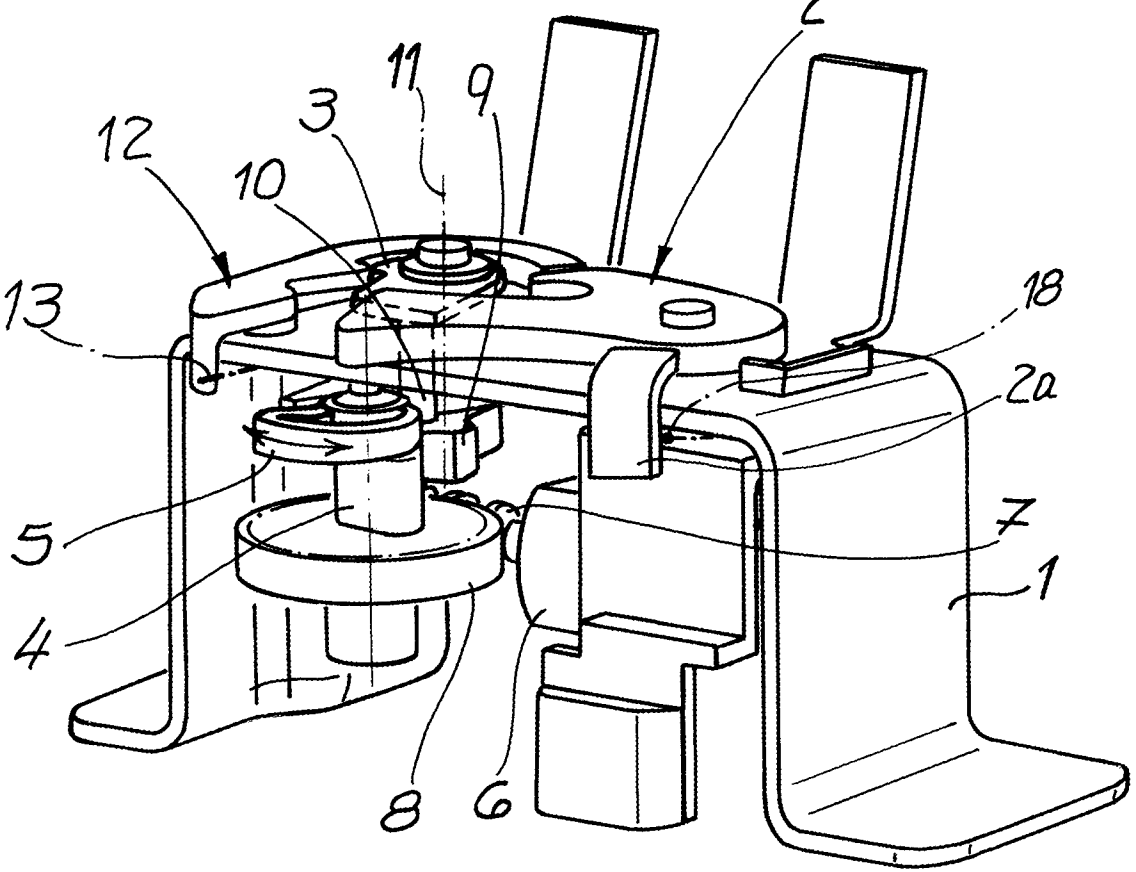

The invention relates to a motor vehicle door latch, in particular a tailgate latch, with a locking mechanism fundamentally comprising a catch and a pawl, furthermore with a triggering element working on the pawl, which is set up at least for lifting of the pawl and with a memory element which guarantees at least an unhindered opening movement of the catch with the pawl lifted.

With a motor vehicle door latch of the construction described at the start, as described in WO 2014/036991 A2, the memory element is formed in such a way that it holds the triggering element firmly during the opening movement of the catch. To this end, the memory element interacts with a relevant contour on the catch and is also connected to the triggering element.

It is known that the memory element or also a memory lever in this context, in particular for tailgate latches, ensures that the pawl does not re-engage with the catch unintentionally when the locking mechanism is open. Such a situation exists for a tailgate latch inter alia if the tailgate pertaining to the tailgate latch cannot be completely opened or cannot be opened due to a snow load or other stresses, for example. Because the motor vehicle door latch in question is then typically opened by remote control or via a Bowden cable, but there is still the unchanged risk of the pawl engaging into the catch.

In practice, scenarios inter alia are observed such that the locking mechanism is not opened further than to the pre-ratchet and the pawl re-engages into the catch, in fact. In order to open the pertaining tailgate and consequently the motor vehicle door latch nevertheless, the opening process in this case needs to be repeated in order to be able to open the tailgate completely in the example case.

In the further category-defining state of the art according to WO 2016/000460 A1 a memory element is executed for this purpose which is acted on by a spring. The spring and the memory element form a constructional unit. Furthermore, the spring and the memory element are configured as the spring lip acting on the triggering element. Compact external dimensions are thus observed and a minimum of functional components are used. The costs should also be reduced hereby.

The state of the art has fundamentally been proven with regard to the basic functionality of the memory element. However, impairments of functions can occur, for example, in such a way that the catch does not interact perfectly with the memory element according to WO 2014/036991 A2 or the spring forming a constructional unit with the memory element or the spring lip, for example, is impaired in its elasticity, for example, due to its age and consequently also perfect functionality is not completely guaranteed or is no longer completely guaranteed and observed. This is where the invention sets in.

The invention is based on technical problem of further developing a motor vehicle door latch of the construction described at the start in such a way that any functional impairments are also prevented over long timescales and perfect memory operation is guaranteed.

In order to solve this technical problem, a class-specific motor vehicle door latch within the scope of the invention is currently characterized in that the memory element maintains the pawl in its elevated position. This means that memory operation according to the invention corresponds to the pawl being maintained in its elevated position with the aid of the memory element, at least during the opening movement of the catch.

In contrast to the state of the art, there is thus no interaction with the catch or the triggering element, but only interaction between the memory element and the pawl. The configuration is advantageously such that the catch detaches the memory element from the pawl in its completely open position. The pawl is thus released from the memory element in the completely open position of the catch. A subsequent closure process of the locking mechanism can therefore be undertaken easily and in an unimpeded manner because the pawl is released from the memory element and can then engage into the closed locking mechanism or into the pre-ratchet and then the main ratchet of the catch independently of the memory element.

The memory element generally assumes two positions, namely a basic position and a working position. The memory element assumes a basic position in the closed position of the locking mechanism. In this basic position, an interaction does not yet occur between the memory element and the pawl.

Only when the locking mechanism is opened and during an opening movement of the catch, the memory element is transferred translationally and/or rotatorily into the working position maintaining the pawl in the elevated position.

This working position of the memory element is maintained until the catch has attained the completely open position and detaches the memory element from the pawl as a result. The memory element now transfers into its basic position which is also assumed and maintained during the entire closure process and in the closed position of the locking mechanism by the memory element.

Only when an opening movement of the locking mechanism and consequently of the catch occurs is the memory element transferred into the working position maintaining the pawl in the elevated position by the opening movement of the catch. Thus, perfect functionality is provided because the memory element is transferred from the closed position into the working position predominantly mechanically and automatically and the catch only detaches the memory element from the pawl in the completely open position. The function of the memory element can thus be guaranteed with durability and functional reliability. These are the crucial advantages.

The memory element is generally pre-tensioned in the direction of its working position with the aid of a spring. The respective spring is typically designed as a leg spring. An end or a leg of the spring is connected to the triggering element. On the contrary, the purpose of the other end of the spring is to act on the memory element in the direction of its working position. A pin is generally provided to attach and accommodate the memory element. In fact, the memory element is accommodated in a slit of the latch housing with the aid of the relevant pin. The latch housing is regularly a latch case in which, in addition to the memory element, the locking mechanism predominantly consisting of a catch and a pawl is typically accommodated. Thus, the memory element moves overall translationally and/or rotatory in a plane formed by the locking mechanism, accommodated on the relevant latch case.

For the detailed design of the memory element, the invention generally recommends that the memory element is fork-shaped. One fork end of the fork is adjacent to the catch, at least in its completely open position. Due to the interaction of the fork end of the memory element with the catch in the completely open position the catch ensures that the memory element is detached from the pawl and consequently releases the pawl. Thus, following the completely open position of the catch, the pawl can engage into the pre-ratchet or main ratchet of the catch unimpeded during a closure process and the locking mechanism can easily be transferred into its closed position. The memory element hereby thoroughly assumes its basic position in which interaction with the pawl does not take place.

In detail, the memory element typically demonstrates a ratchet recess into which a ratchet hook on the catch engages during an opening movement of the catch. Thus, during the opening movement of the catch, and consequently of the locking mechanism, in the then assumed working position of the memory element interaction of the memory element with the pawl happens in such a way that the memory element maintains the pawl in the elevated position, as requested for. Because in this elevated position the ratchet hook on the pawl engages into the ratchet recess of the memory element in such a way that the memory element maintains the pawl in the elevated position.

It has also proven beneficial if the catch is equipped with a jib. A spring can be adjacent on the relevant jib. The spring is typically a catch spring, i.e. a spring which pre-tensions the catch in its open position. Therefore, as soon as the pawl is moved in the opening direction and has been released from the pawl, the respective spring or catch spring ensures that the catch is impinged in the relevant opening direction.

As a result, a motor vehicle door latch is provided which is suited in particular for use as a tailgate latch. Because the additionally provided memory element guarantees an unimpeded opening movement of the catch when the pawl is elevated. To this end, the memory element is configured in such a way that it maintains the pawl in the elevated position, at least during the opening movement of the catch. Only when the catch assumes its completely open position does it ensure that the memory element is detached from the pawl.

Now the memory element can return to its basic position in which the memory element and the pawl are free from one another. In contrast, the working position of the memory element corresponds to the ratchet hook on the pawl reaching behind the ratchet recess of the memory element. The working position is only assumed during the opening movement of the catch. Thus, a motor vehicle door latch is provided which is especially functionally reliable, of a simple construction and cost-effective to execute.

Figure 2:
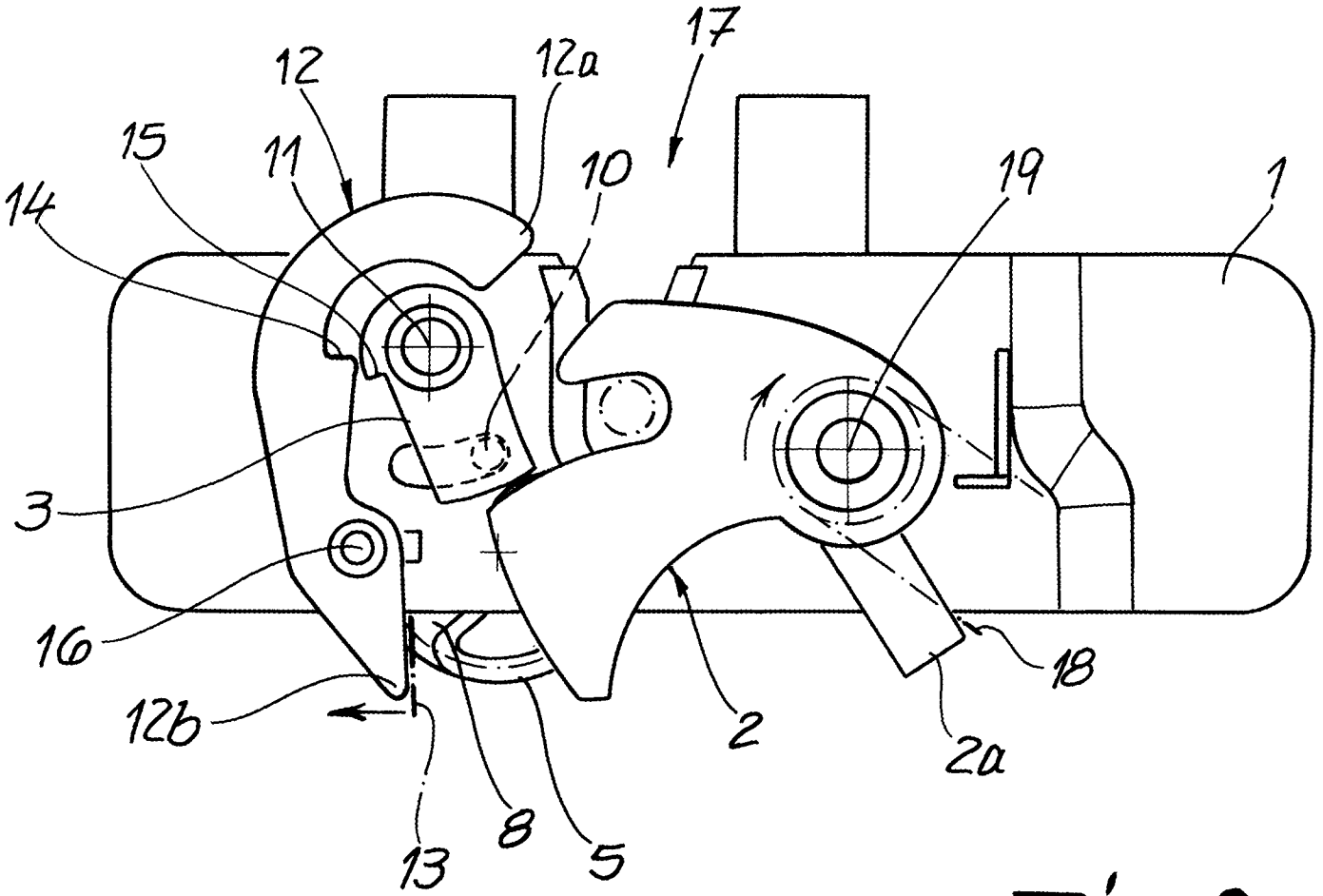
Figure 3:
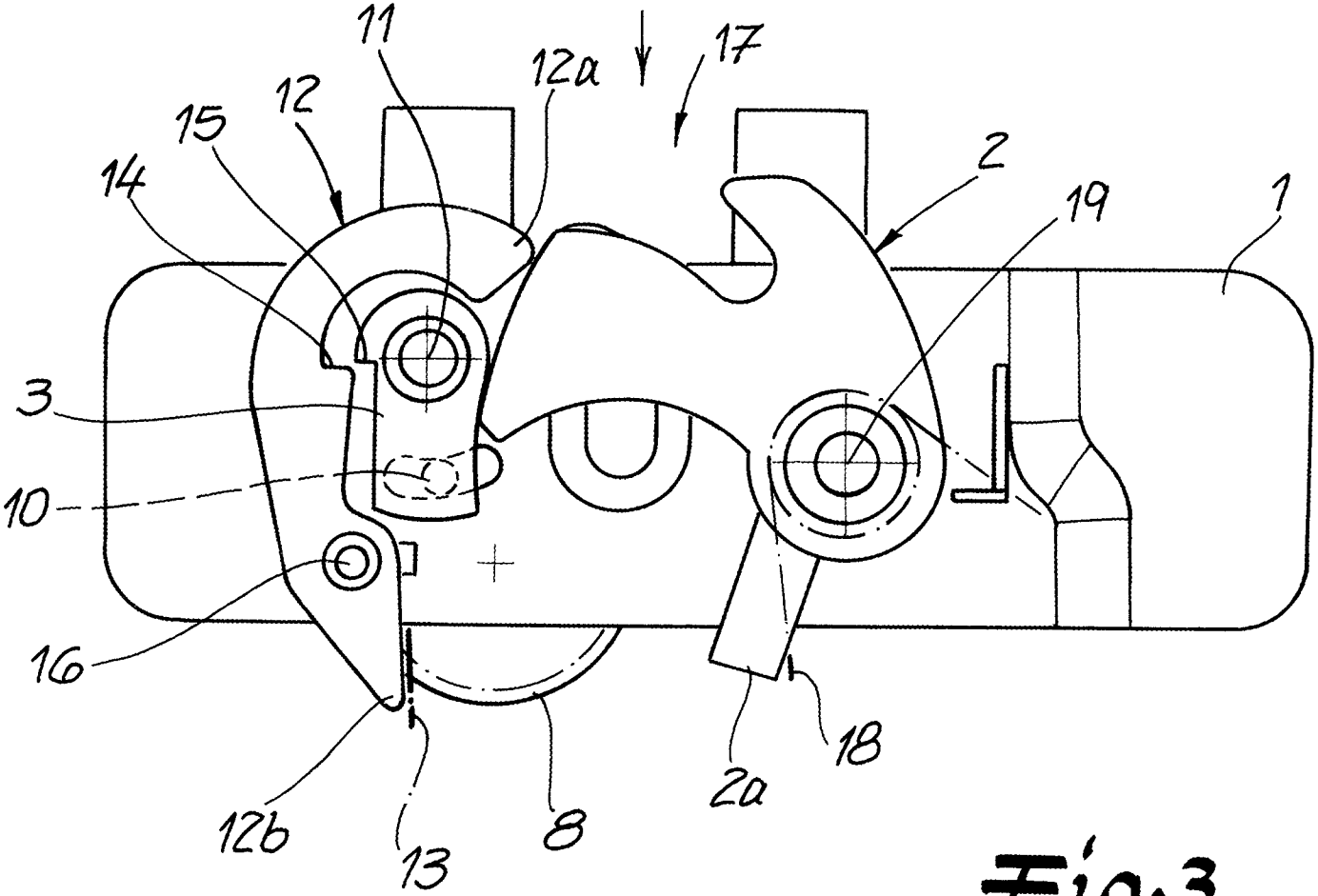

Hereinafter, the invention is explained in further detail on the basis of drawings which only depict one design example. It shows:

FIG. 1 The motor vehicle door latch according to the invention in a perspective view, FIG. 2 a top view of the object according to FIG. 1 with the locking mechanism in a closed position and FIG. 3 the locking mechanism according to FIG. 2 during an opening process.

In FIG. 1 a motor vehicle door latch is depicted in a perspective view with the components crucial for the invention. One recognizes an U-shaped latch case or a latch plate 1 initially as a component of a latch housing, not outlined in further detail, to which a non-illustrated latch hood which may be made of plastic may also belong. A locking mechanism 2, 3 fundamentally comprising a catch 2 and a pawl 3 is accommodated on the latch case 1. Furthermore, a triggering element 9 working on the pawl 2 and a connecting pin 10 are also recognized. The triggering element 9 including the connecting pin 10 is acted on according to the design example and not restrictedly with the aid of a drive 4, 5, 6 7, 8.

The drive 4, 5, 6, 7, 8 comprises an electromotor 6, a worm 7 connected on the output side to a pinion shaft of the electromotor 6 and a gearwheel 8 combing with the worm 7, which is formed on an output element 4, 5, 8. Pivoting movements or rotational movements of the pinion shaft and consequently the worm 7 on the output side on the electromotor 6 ensure that the output element 4, 5, 8 in FIG. 1 can execute indicated rotational movements in both directions.

The output element 4, 5, 8 is not only equipped with the relevant gearwheel 8, but also with an output tappet 5 which is coaxially connected to the gearwheel 8 via a connecting shaft 4. The output tappet 5 can work on the connecting pin 10.

The connecting pin 10 in the design example ensures that the pawl 3 and the triggering element 9 are connected to one another in a torque-proof manner. Therefore, as soon as the drive tappet 5 travels against the connecting pin 10 the triggering element 9 and also the pawl 3 are pivoted around their common axis 11. This means that the opening of the locking mechanism 2, 3 fundamentally comprising a catch 2 and a pawl 3 starts from the closed state illustrated in FIG. 2 with the aid of the electromotor drive 4, 5, 6, 7, 8.

A memory element 12, which is recognized in particular in FIGS. 2 and 3 is now crucial for the invention. The memory element 12 is fork-shaped in the execution example. As explained in further detail hereinafter, a fork end 12*a* can interact with the catch 2, as during the opening process in FIG. 3 and is illustrated there. Another fork end 12*b* opposite is acted on by a spring 13 on the contrary. The spring 13 is connected or adjacent to the triggering element 9 with one end and to the relevant memory element 12 with its other end or the pertaining fork end 12*b*. With the aid of the spring 13 the memory element 12 is impinged in the direction of its working position, to the left according to the execution example in FIG. 2, as depicted by an arrow there.

The memory element 12 is equipped with a ratchet recess 14 which can interact with a ratchet hook 15 on the pawl 3, as explained in further detail hereafter. Furthermore, the memory element 12 has a pin 16, with the aid of which the memory element 12 is accommodated in a slit in the latch housing or latch case 1.

If one initially starts from the closed position of the locking mechanism 2, 3 according to the illustration in FIG. 2, one recognizes that the pawl 3 maintains the catch 2 in its closed position. Thus, a locking bracket or locking bolt inserted into an infeed section 17 illustrated there can be maintained with the aid of the catch 2 or the locking mechanism 2, 3 overall in the closed position. The pertaining motor vehicle door or tailgate is closed. The pawl 3 is adjacent to the catch 2 with a relatively large contact surface.

Due to the pawl 3 being in a closed position adjacent to the catch 2 the ratchet hook 15 on the pawl 3 cannot interact with the ratchet recess 14 of the memory element 12.

To open the locking mechanism 2, 3 the drive or electromotor drive 4, 5, 6, 7, 8 is now energized and acted on in such a way that the output tappet 5 impinges the triggering element 9 and the pawl 3 connected in a torque-proof manner via the connecting pin 10 starting from the position in FIG. 2 in such a way that the pawl 3 executes a slight clockwise direction movement until it assumes the position according to the illustration in FIG. 3 and consequently the catch 2 is detached from the pawl 3.

The catch 2 is equipped with a tappet 2*a*. A spring or catch spring 18 touches the tappet 2*a* which acts on the catch 2 starting from the closed position according to FIG. 2 in a clockwise direction around its axis 19 as depicted by a relevant arrow in FIG. 2.

As soon as the pawl 3 releases the catch 2, the catch 2 is opened with the aid of the spring 18 and releases the previously caught locking bracket or locking bolt. At the same time, the rotated position of the pawl 3 ensures that the ratchet hook 15 on the pawl 3 engages into the ratchet recess 14 of the memory lever 12 or can reach behind the ratchet recess 14. Thus, the memory element 12 is transferred from its basic position illustrated in FIG. 2 into the working position without interaction with the pawl 3. In this working position, the ratchet hook 15 on the pawl 3 can reach behind the ratchet recess 14 of the memory element 12.

Thus, the memory element 12 is initially translationally and/or rotatory transferred from the basic position according to FIG. 2 into the working position, as already depicted by the arrow pointing to the left in FIG. 2. The working position of the memory element 12 is assumed before the locking mechanism 2, 3 is completely opened, as illustrated in FIG. 3. The memory element 12 is conducted into the slit of the latch case 1 with the aid of the pin 16. At the same time, the working position of the memory element 12 ensures that the pawl 3 is maintained in the elevated position and consequently cannot (can no longer) interact with the catch 2 during its opening movement.

As soon as the catch assumes its completely open position illustrated in FIG. 3, the catch 2 ensures that the memory element 12 is triggered by the pawl 3. Because in this case the fork end 12*a* of the fork-shaped memory element 12 travels against the catch 2 and the catch 2 in the completely open position ensures that the memory element 12 is lifted from the pawl 3 via the fork end 12*a*. The memory element 12 now once again assumes its basic position already illustrated in FIG. 2.

Starting from the completely open position according to FIG. 3 a locking bracket or locking bolt entering the catch 2 can once again ensure that the locking mechanism 2, 3 is closed and subsequently the pawl 3 which is free from the memory element 12 engages into the catch 2, as illustrated in FIG. 2.

The invention claimed is:

1. A motor vehicle door latch for a tailgate, the motor vehicle door latch comprising:

a locking mechanism including a catch and a pawl;

a triggering element arranged to lift the pawl;

a memory element configured to ensure an unhindered opening movement of the catch when the pawl is lifted to an elevated position, the memory element being operative to maintain the pawl in the elevated position when in a working position of the memory element, wherein the memory element at least partly encircles the pawl; and a spring configured to bias the memory element toward the working position, wherein the spring is connected to the triggering element and to the memory element, the spring being connected to the memory element at an end of the memory element that is opposite of the end of the memory element that engages the catch.

2. The motor vehicle door latch according to claim 1, wherein the catch is configured to detach the memory element from the pawl in a completely open position.

3. The motor vehicle door latch according to claim 1, wherein the memory element is configured to be transferred from a basic position assumed in a closed position of the locking mechanism with an opening movement of the catch translationally and/or rotationally into the working position in which the memory element maintains the pawl in the elevated position.

4. The motor vehicle door latch according to claim 1, wherein the spring is connected with one end to the triggering element and is adjacent to the memory element with another end.

5. The motor vehicle door latch according to claim 1 further comprising:

a latch case having a slit; and a pin that is movable along the slit, wherein the memory element is accommodated in the slit of a latch case via the pin.

6. The motor vehicle door latch according to claim 1, wherein the memory element is fork-shaped, wherein a fork end is adjacent on the catch when the catch is in a completely open position.

7. The motor vehicle door latch according to claim 1, wherein the memory element has a ratchet recess, in which a ratchet hook on the pawl engages during the opening movement of the catch.

8. The motor vehicle door latch according to claim 1, wherein the catch is equipped with a jib.

9. The motor vehicle door latch according to claim 8, wherein a spring is adjacent on the jib of the catch.

10. The motor vehicle door latch according to claim 1, wherein a first rotatable axis of the pawl is arranged closer to a second rotatable axis of the memory element as compared with a third rotatable axis of the catch.

11. The motor vehicle door latch according to claim 1, wherein the memory element is arranged to surround at least a side of the pawl.

12. The motor vehicle door latch according to claim 1, wherein the memory element extends around a rotatable axis of the pawl.

13. The motor vehicle door latch according to claim 1, wherein a first rotational axis of the pawl is arranged between a second rotational axis of the memory element and the opposite end of the memory element that engages the catch.

14. The motor vehicle door latch according to claim 1 further comprising a connecting pin connected between the pawl and the triggering element.

15. The motor vehicle door latch according to claim 14, wherein the connecting pin extends parallel relative to a rotational axis of the pawl.

16. The motor vehicle door latch according to claim 1, wherein a first rotational plane of the pawl is parallel with a second rotational plane of the triggering element.

17. A motor vehicle door latch for a tailgate, the motor vehicle door latch comprising:

a locking mechanism including a catch and a pawl;

a triggering element arranged to lift the pawl;

a memory element configured to ensure an unhindered opening movement of the catch when the pawl is lifted to an elevated position, the memory element being operative to maintain the pawl in the elevated position when in a working position of the memory element;

a spring configured to bias the memory element toward the working position, wherein the spring is connected to the triggering element and to the memory element, the spring being connected to the memory element at an end of the memory element that is opposite of the end of the memory element that engages the catch;

a latch case having a slit; and a pin that is movable along the slit, wherein the memory element is accommodated in the slit of a latch case via the pin.

18. A motor vehicle door latch for a tailgate, the motor vehicle door latch comprising:

a locking mechanism including a catch and a pawl;

a triggering element arranged to lift the pawl;

a memory element configured to ensure an unhindered opening movement of the catch when the pawl is lifted to an elevated position, the memory element being operative to maintain the pawl in the elevated position when in a working position of the memory element;

a connecting pin connected between the pawl and the triggering element; and a spring configured to bias the memory element toward the working position, wherein the spring is connected to the triggering element and to the memory element, the spring being connected to the memory element at an end of the memory element that is opposite of the end of the memory element that engages the catch.

19. The motor vehicle door latch according to claim 18, wherein the connecting pin extends parallel relative to a rotational axis of the pawl.

* * * * *